United States Patent [19]

Hajcak, Jr.

[11] Patent Number: 4,664,036

[45] Date of Patent: May 12, 1987

[54] CONVEYOR HAVING CURVED TRACK SECTION

[75] Inventor: John T. Hajcak, Jr., Phillipsburg, N.J.

[73] Assignee: SI Handling Systems, Inc., Easton, Pa.

[21] Appl. No.: 644,743

[22] Filed: Aug. 27, 1984

[51] Int. Cl.[4] ..... B61B 10/04

[52] U.S. Cl. ..... 104/172.2; 104/189; 384/7; 198/841

[58] Field of Search ..... 104/140, 172 R, 172 B, 104/172 BT, 173 R, 189, 172.2; 198/735, 837, 841; 384/7, 42

[56] References Cited

U.S. PATENT DOCUMENTS

| | | | |
|---|---|---|---|
| 2,866,538 | 12/1958 | Goldberg | 198/841 |
| 3,265,192 | 8/1966 | Stadelman | 198/841 X |
| 3,389,662 | 6/1968 | Jacoby | 104/172 |
| 3,391,650 | 7/1968 | Goforth et al. | 104/189 X |
| 3,467,025 | 9/1969 | Bradt | 104/189 X |
| 3,796,296 | 3/1974 | Bakker | 198/735 |
| 3,857,473 | 12/1974 | Kornylak | 198/837 X |
| 3,964,800 | 6/1976 | Grimes et al. | 384/42 |
| 4,222,483 | 9/1980 | Wootton et al. | 198/841 X |
| 4,576,277 | 3/1986 | Park et al. | 198/841 X |

FOREIGN PATENT DOCUMENTS

| | | | |
|---|---|---|---|
| 2000725 | 3/1970 | Fed. Rep. of Germany . | |
| 2218567 | 6/1973 | Fed. Rep. of Germany . | |
| 2319057 | 10/1974 | Fed. Rep. of Germany | 104/189 |

*Primary Examiner*—Robert B. Reeves
*Assistant Examiner*—David F. Hubbuch
*Attorney, Agent, or Firm*—Seidel, Gonda, Goldhammer & Abbott

[57] ABSTRACT

A conveyor system for driverless vehicles includes a channel-shaped track adapted to be mounted in a floor. The track has at least one curved section. Along the inner leg of the curved section, there is provided a polymeric plastic liner which is characterized by a low friction and high abrasion resistance. The liner is adapted to contact a side face of a chain disposed within the track.

6 Claims, 5 Drawing Figures

FIG. 1
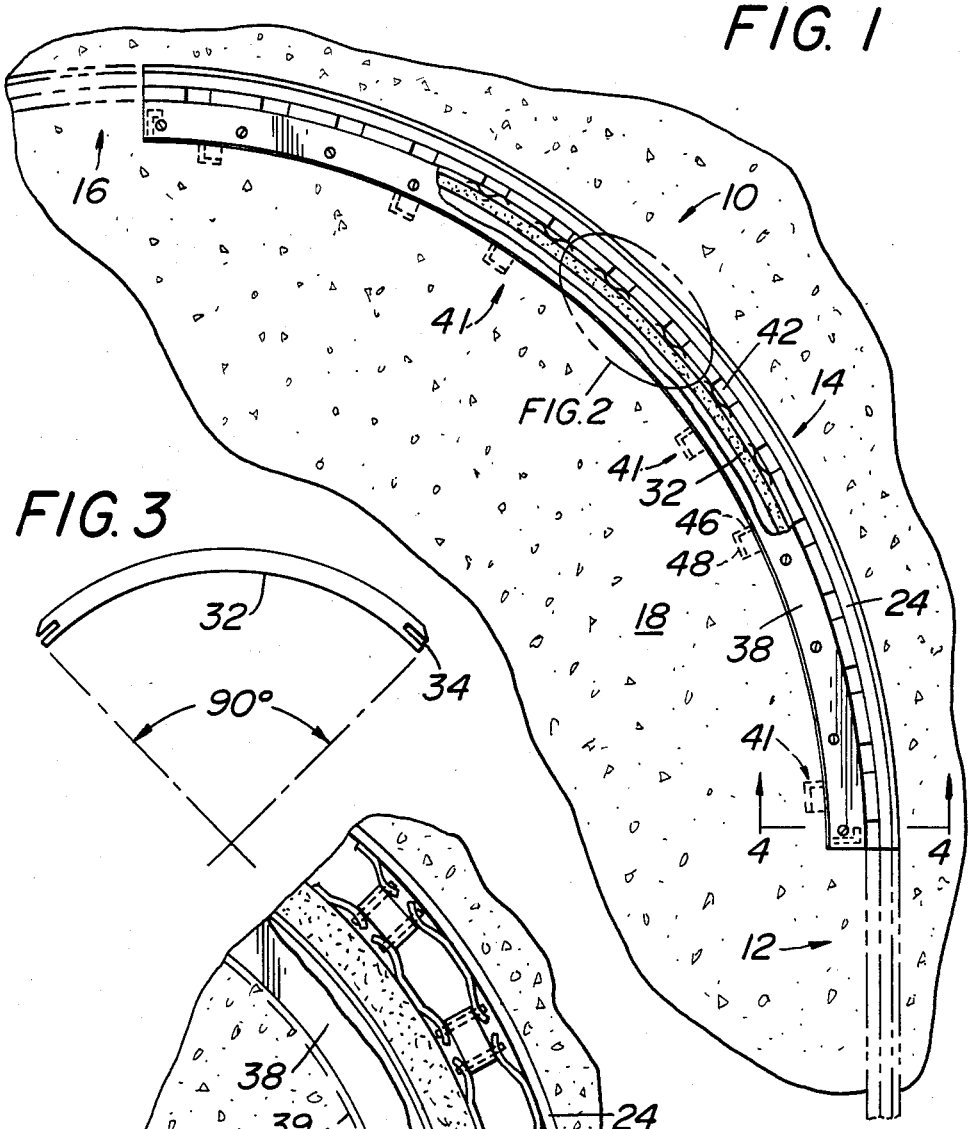
FIG. 3
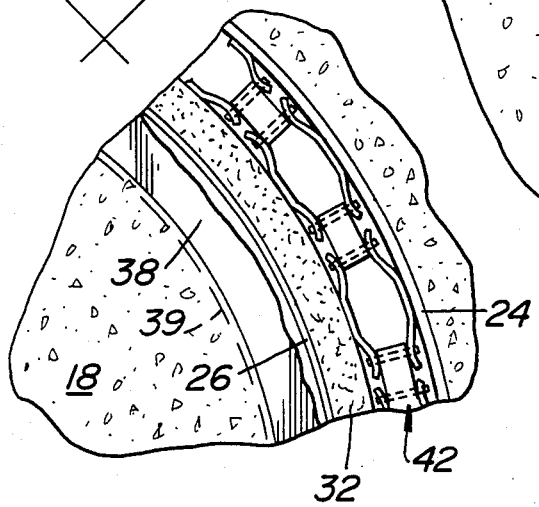
FIG. 2

FIG. 4
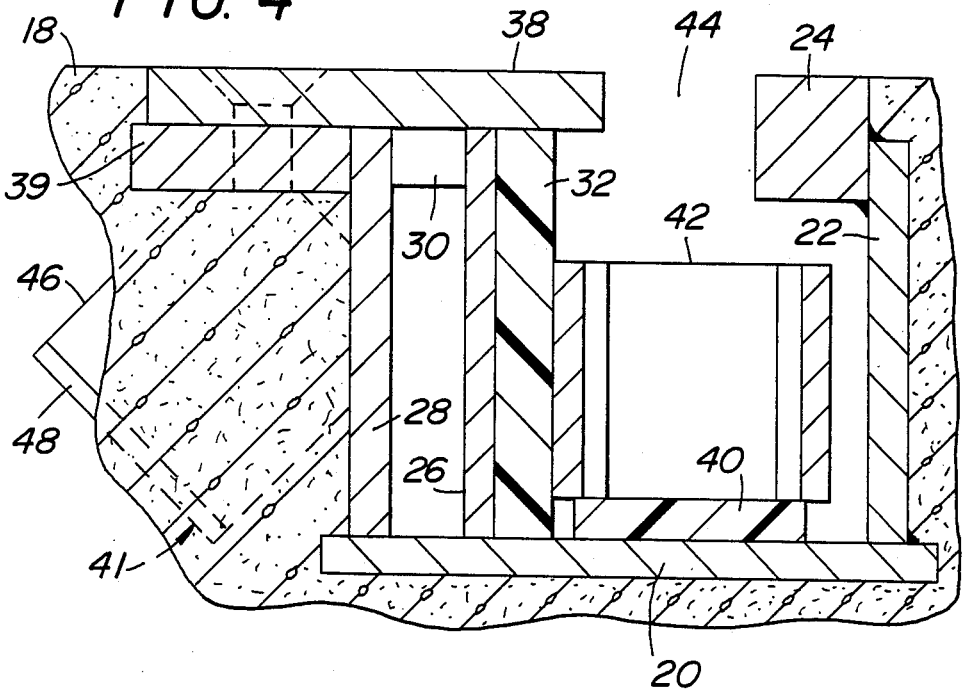
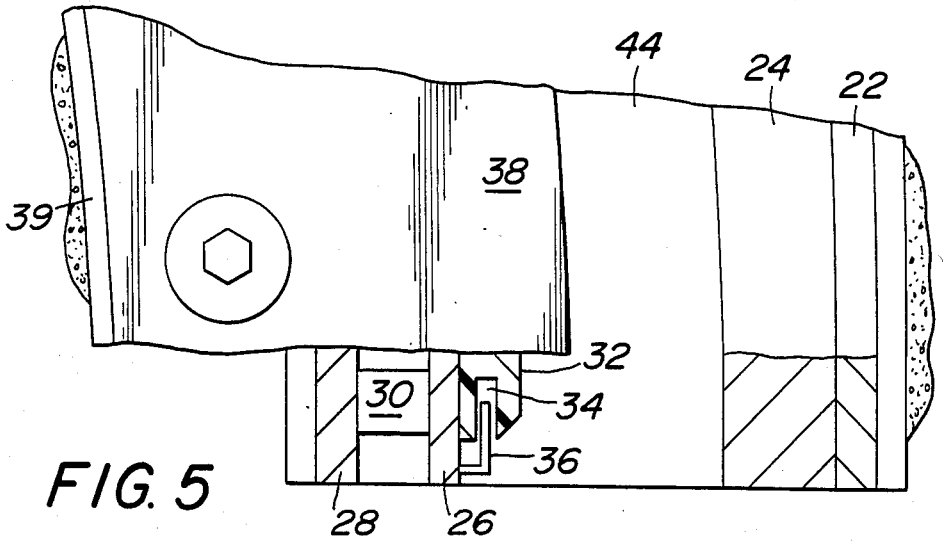
FIG. 5

CONVEYOR HAVING CURVED TRACK SECTION

BACKGROUND OF THE INVENTION

Channel-shaped tracks which are mounted in a floor and adapted to receive a chain for pulling vehicles along the track are per se known. Such tracks usually have a curved section. At the curved section, some type of contact surface is provided for contacting a side face of the chain to minimize friction forces.

The present invention is directed to solution of the problem of providing a curved section of a conveyor with a contact surface which is easy to install, has little or no maintenance, has no moving parts, has low friction, is inexpensive, and which is quiet in operation.

SUMMARY OF THE INVENTION

The invention is directed to a conveyor system for driverless vehicles. The system includes a channel-shaped track adapted for receiving a chain for pulling vehicles there along. The track is curved at least in part with the curved part having an inner leg and outer leg. The inner leg has a mating elongated curved member positioned for frictional contact with a side face of a chain. The curved member is a polymeric plastic having low friction and high abrasion resistance.

It is an object of the present invention to provide a conveyor having a curved track section with a chain back-up or contact member which is easy to install, requires no maintenance, has no moving parts, is less expensive, has low friction and is quiet in operation.

Other objects and advantages will appear hereinafter.

For the purpose of illustrating the invention, there is shown in the drawings a form which is presently preferred; it being understood, however, that this invention is not limited to the precise arrangements and instrumentalities shown.

FIG. 1 is a partial plan view of a floor having a track imbedded therein.

FIG. 2 is an enlarged detailed view of the portion within the ellipse in FIG. 1.

FIG. 3 is a bottom plan view of a curved member which is used to contact the chain at the curved portion of a track.

FIG. 4 is a sectional view taken along the line 4—4 in FIG. 1 but on an enlarged scale.

FIG. 5 is a partial plan view of one end of the curved track section on the scale of FIG. 4.

DETAILED DESCRIPTION OF THE INVENTION

Referring to the drawings in detail, wherein like numerals indicate like elements, there is shown in FIG. 1 a conveyor system in accordance with the present invention designated generally as 10. As illustrated in FIG. 1, the system 10 includes a straight track section 12 connected to a curved track section 14 which in turn is connected to another curved track section 16. The arcuate lenght of track sections 14 and 16 is not more than 90°. The system is shown installed in a floor 18. If desired, the system 10 could be installed in a ceiling or supported from a ceiling.

Referring to FIG. 4, the channel-shaped track includes a bottom wall 20 which is imbedded in the floor 18 at a depth of about 3 inches (7.6 cm). An upstanding outer wall or leg 22 is supported by the bottom wall 20. A wear bar 24 is connected to the upper end of the wall 22 so as to be flush with the floor 18. Along the inner periphery of the section 14, there is provided inner leg or walls 26, 28 which are spaced from one another and connected together by spacers 30 at spaced points there along. Each of the walls 26 and 28 is secured to the uppermost surface of the bottom wall 20.

A liner or chain contact member 32 extends along and mates with the outer peripheral surface of the inner wall 26. The height of member 32 corresponds to the height of wall 26 but member 32 is thicker than wall 26. Member 32 is a polymeric plastic material having low friction and high resistance to abrasion when in contact with a metal chain. Member 32 is preferably a material such as ultrahigh molecular weight polyethylene which has a molecular weight of 3 million to 6 million (ASTM D4020).

Member 32 as described above has a low relative volumetric abrasion coefficient of 100 as determined by a conventional sand abrasion test. That value compares with comparable coefficients of 600 for low density polyethylene, 530 for TEFLON, 700 for acetal copolymer, 160 for carbon steel, 660 for polypropylene, and 2500 for phenolic resin. The higher the coefficient the higher the abrasion loss and the lower the abrasion resistance. Thus, the abrasion resistance of member 32 is substantially higher than that of carbon steel.

Member 32 has a low dynamic coefficient of friction, namely 0.05 to 0.08 based on tests against polished steel with an oil film. Member 32 will be in contact with a chain which is oiled. Hence, the oiled condition of member 32 is considered to be more appropriate than a wet or dry condition. Comparable coefficients of friction for other materials are 0.01–0.11 for nylon-6, 0.04–0.05 for TEFLON, and 0.05–0.10 for DELRIN (linear polyoxy methlene-type acetal resin).

To facilitate ease and simplicity of installation, member 32 is provided with a slot 34 at each end. The height of each slot is preferably less than the height of the member 32 whereby the slots are not exposed on the top surface of member 32. Wall 26 supports a projection 36 adjacent each end thereof. Each projection 36 extends into the adjacent slot 34 with sufficient clearance so as to allow for thermal expansion while preventing movement in an outward direction and in a lengthwise direction.

Member 32 is retained in position and prevented from moving upwardly by the top wall 38 which is flush with the floor 18. Top wall 38 is removably bolted to a curved bar 39 which is supported by and welded to brace 41. Brace 41 is also welded to wall 28. A brace 41 is provided at spaced locations along section 14. Braces 41 provide the added function of being an anchor in the concrete from which floor 18 is made. Braces 41 include mutually perpendicular walls 46, 48 with the side edges of wall 46 being at an angle of about 45°.

The bottom wall 20 may be provided with a wear plate 40 on which rides the chain 42. The chain 42 is per se known and is made of a plurality of metal segments having parallel side faces and which are pivotably coupled together with a plurality of metal pusher members. The pusher members have a reaction surface adapted to contact a tow pin on a driverless vehicle when the tow pin extends through the gap 44. The member 32 is only utilized in the curved track sections 14 and 16.

The member 32 is sufficiently flexible so that it can be bent to conform to the curvature of the inner wall 26. The member 32 is held at its ends by the projections 36 and is held against vertical movement by the top wall 38. Thus, member 32 is simple and easy to install. Since member 32 has no moving parts, there is practically no maintenance and it is inexpensive while having low friction for quiet operation while at the same time having high abrasion resistance. When member 32 needs replacing, top wall 38 is removed, member 32 is pulled out of the track, and a new member 32 is inserted.

The present invention may be embodied in other specific forms without departing from the spirit or essential attributes thereof and, accordingly, reference should be made to the appended claims, rather than to the foregoing specification, as indicating the scope of the invention.

I claim:

1. A conveyor system for driverless vehicles comprising a channel-shaped track adapted for receiving a chain for pulling vehicles, said track being curved at least in part so as to have an inner leg and an outer leg on opposite sides of an access gap, said inner leg having a mating elongated curved member positioned for frictional contact with a side face of a chain along said curved part of the track, said member being a polymeric plastic having a low coefficient of friction and high abrasion resistance when in contact with metal, and means for removably securing said member so as to be stationary and within said track along said curved part of said track and including a top wall and a bottom wall on said track, said member being clamped between said top and bottom walls.

2. A system in accordance with claim 1 wherein said last mentioned means also includes projections on said track, each projection extending into a slot adjacent an end of said member with a loose fit so as to accommodate thermal expansion.

3. A conveyor system for driverless vehicles comprising a channel-shaped track imbedded in a floor and having a gap at its upper end adjacent the floor level for receiving a tow pin on a driverless vehicle, a chain in said track, said track being curved at least in part, said track having vertically disposed walls on opposite sides of said gap, along said curved part of the track one of said walls being an inner wall and the other being an outer wall, a stationary curved liner in contact with the inner wall along said curved part and adjacent said gap for frictional contact with a side face of said chain, said curved liner being a polymeric plastic having an abrasion resistance higher than that of carbon steel, said track including a top wall flush with the floor and overlying the upper end of said liner, and means removable securing said liner to said track, said means including spaced elements on the track engaging mating portions of said liner with a fit that accommodates thermal expansion and a top wall and a bottom wall on said track, said liner being restrained against vertical movement by said top and bottom walls.

4. A conveyor system for driverless vehicles comprising a channel-shaped track imbedded in a floor and having a gap at its upper end adjacent floor level for receiving a tow pin on a driverless vehicle, a chain in said track, said track being curved at least in part, said track having vertically disposed walls on opposite sides of said gap, along said curved part of the track one of said walls being an inner wall and the other being an outer wall, a stationary curved liner in contact with the inner wall along said curved part and adjacent said gap for frictional contact with a side face of said chain, said curved liner being a polymeric plastic having an abrasion resistance higher than that of carbon steel, said track including a top wall flush with the floor and overlying the upper end of said liner, and means removably securing said liner to said track, said means including spaced elements on the track engaging mating portions of said liner with a fit that accommodates thermal expansion and said track including a second inner wall radially inwardly of said first mentioned inner wall, spacers extending between said inner walls at spaced locations, said top wall being removably connected to a curved bar radially inwardly of said second inner wall, and a brace-anchor attached to said second inner wall radially inwardly thereof.

5. An system in accordance with claim 4 wherein said brace-anchor includes perpendicular walls one of which has side edges at an acute angle with respect to the floor.

6. A conveyor system for driverless vehicles comprising a channel-shaped track imbedded in a floor and having a gap at its upper end adjacent floor level for receiving a tow pin on a driverless vehicle, a chain in said track, said track being curved at least in part, said track having vertically disposed walls on opposite sides of said gap, one of said walls along said curved part of the track being an inner wall and the other being an outer wall, a stationary curved liner in contact with and thicker than the inner wall along said curved part, said liner being adjacent said gap for frictional contact with a side face of said chain, said liner being a polymeric plastic having an abrasion resistance which is higher than that of steel and a low coefficient of friction when in contact with steel, said track having a top wall flush with the floor and defining one side edge of said gap, said top wall engaging said liner for preventing movement of the liner in a vertical direction, and means including spaced elements connected to said track and contacting said liner adjacent the ends of the liner for restraining movement of the liner in a lengthwise direction and in a radially outwardly direction.

* * * * *